US006699013B2

(12) United States Patent
Zweighaft et al.

(10) Patent No.: US 6,699,013 B2
(45) Date of Patent: Mar. 2, 2004

(54) FORCED AIR COOLING FAN HAVING PIVOTAL FAN BLADES FOR UNIDIRECTIONAL AIR FLOW

(75) Inventors: James Zweighaft, Boulder, CO (US); Philip John Turner, Broomfield, CO (US)

(73) Assignee: Quantum Corporation, Milpitas, CA (US)

( * ) Notice: Subject to any disclaimer, the term of this patent is extended or adjusted under 35 U.S.C. 154(b) by 0 days.

(21) Appl. No.: 10/159,840

(22) Filed: May 31, 2002

(65) Prior Publication Data

US 2003/0223867 A1 Dec. 4, 2003

(51) Int. Cl.[7] ..... F04D 29/38

(52) U.S. Cl. ..... 416/1; 416/131; 416/175; 416/182; 415/911

(58) Field of Search ..... 416/1, 131, 132 A, 416/132 R, 142, 175, 182; 415/911

(56) References Cited

U.S. PATENT DOCUMENTS 811,599 A * 2/1906 Turner ..... 416/131
5,793,740 A 8/1998 Nguyen
6,359,856 B2 3/2002 Nguyen

* cited by examiner

*Primary Examiner*—Edward K. Look
*Assistant Examiner*—Richard A. Edgar
(74) *Attorney, Agent, or Firm*—Patton Boggs LLP

(57) ABSTRACT

The forced air cooling fan comprises a flat disk surface having a series of circumferentially spaced apertures each including a V-shaped fan blade connected across the aperture perpendicular to the periphery of the disk-shaped surface. The V-shaped fan blade includes a pivoting device having a first blade member of one side and a second blade member of the opposing side of the pivoting device. In one position of the V-shaped fan blade, the first blade member covers a first portion of the aperture and the second blade members directs the flow of air downwardly through a second portion of the aperture. V-shaped fan blades allow the direction of the forced air to remain relatively constant when the rotational direction of the drive mechanism is reversed.

11 Claims, 2 Drawing Sheets

FORCED AIR COOLING FAN HAVING PIVOTAL FAN BLADES FOR UNIDIRECTIONAL AIR FLOW

FIELD OF THE INVENTION

The invention relates generally to electronic equipment cooling apparatus and in particular to a cooling fan for removal of operating heat from the interior of an electronic device.

Problem

It is a problem in the field of electronic equipment that generates heat during normal operation to remove the operational heat to prevent premature equipment failure. Various electronic components used in computers, such as microprocessors, generate heat during their normal operation. If not removed from the heat-generating component, the heat raises the device temperature to a level that degrades the reliability and service life of the device, and may also adversely affect nearby components as well. This problem has become more acute in recent years due to the increasing power and speed of microprocessors, and other electronic components, accompanied by correspondingly greater heat generation.

One heat dissipation solution has been to place one or more cooling fans in the computer housing and use the fan(s) to create a flow of cooling air through the housing. The fan receives at least a portion of the component operating heat and discharges it to ambient air surrounding the electronic equipment housing. The placement of one or more cooling fans in a electronic equipment housing, however, takes up valuable space within the electronic equipment which may already be at a premium for installation of other peripheral devices such as CD ROM drives, multiple floppy drives and larger hard drives.

In many types of electronic equipment, fans are used for cooling by way of blowing air over the electronics, thereby dissipating the excess heat generated by the electronics. Through proper sizing of the fan and flow control of the air driven by the fan, the electronic equipment can be maintained at a stable operating temperature even though ambient air temperatures may be quite high.

In many applications, however, the cooling fan represents one of the least reliable components used in an electronic system due to its primarily mechanical nature. In high availability electronic equipment, the cooling system must be further enhanced in order to increase its reliability. In one design technique, redundant fans are used in order to provide a backup cooling system when the primary cooling system fails. However, in order to maintain adequate airflow after the failure of a cooling fan, complete redundancy is required, thus increasing the cost, required space, and complexity of the electronic equipment.

An even more pressing design problem in highly compact computers, such as notebook computers, is that there may not be room for a separate cooling fan to remove operating heat. In this type of electronic equipment the designer must rely on radiation and natural convection from the exterior surface of the computer housing to remove the operating heat. This approach is limited by two factors. The maximum exterior surface area of the computer housing available for such radiant and convective operating heat dissipation, and the maximum temperature to which the exterior housing surface can be permitted to rise during computer operation before the housing becomes objectionably warm to the touch.

Computer peripheral equipment has used fans for many years to remove heat generated by electronic and mechanical sources. Recent advances in the size of transistors have elevated heat control to a primary limiting factor in many designs. When convection and conduction are insufficient to remove enough heat to maintain satisfactory operating temperatures, it is common practice to add a fan to the device for additional airflow. This adds cost, noise and increased physical size to the device at hand.

Typical computer peripherals such disk and tape drives employ one or more motors. It is possible to use these motors to move air in addition to their primary functions because the load presented by a fan blade is typically quite light in comparison to the other requirements of the motors.

A disk drive driven forced air cooling apparatus is disclosed by Nguyen (U. S. Pat. Nos. 5,793,740 and 6,359,856). In Nguyen, the spindle on which a data storage medium rotates also rotates a plurality of fan blades. The circumferentially sloped blades create a forced cooling air flow within the electronic equipment housing without requiring excessive additional space for a fan assembly or substantially increasing the cost. When the data storage drive rotates in one direction, the rotating blades create an axial flow of air that passes downwardly. Rotation of the data storage drive in the opposite direction create an axial flow of air that passes upwardly. The slope of the blade members dictates the direction in which the air flows.

A problem occurs when the apparatus is used in conjunction with a data storage device in which the disk drive motor rotation is bi-directional. Because reel motors in a tape drive must reverse direction periodically, it is not practical to couple them directly to a traditional fan blade for cooling purposes. This is because the heat generating sources (typically electronic circuit boards and the motors themselves) must be vented to the outside without routing hot air though the tape path itself which is sensitive to heat buildup. A venting design which moves hot air away from the tape path for one direction of motor rotation will move the hot air into the tape path when the rotational direction of the motor reverses. This can make the situation worse than no venting at all.

For these reasons, a need exists for a fan that will direct the flow of air in the same direction regardless of the rotational direction of the motor to which it is coupled.

Solution

The fan comprises a flat disk surface having a series of circumferentially spaced apertures wherein each aperture includes a V-shaped fan blade connected across the aperture perpendicular to the periphery of the disk-shaped surface. The V-shaped fan blade includes a pivoting device having a first blade member of one side and a second blade member of the opposing side of the pivoting device. In one position of the V-shaped fan blade, the first blade member covers a first portion of the aperture and the second blade members directs the flow of air downwardly through a second portion of the aperture. V-shaped fan blades allow the direction of the forced air to remain relatively constant when the rotational direction of the drive mechanism is reversed.

When the rotational direction of the drive mechanism is reversed, the flow of air pushes the second blade member downward causing the attached first blade member to pivot upward. When the first blade members is fully extended upward, the first portion of the aperture is uncovered and the first blade member directs the flow of air downwardly through the first aperture.

DESCRIPTION

The forced air cooling fan having pivotal fan blades for unidirectional air flow summarized above and defined by the enumerated claims may be better understood by referring to the following detailed description, which should be read in conjunction with the accompanying drawings. This detailed description of the preferred embodiment is not intended to limit the enumerated claims, but to serve as a particular example thereof. In addition, the phraseology and terminology employed herein is for the purpose of description, and not of limitation.

A fan is a device for agitating air or gases or moving them from one location to another. Mechanical fans with revolving blades are commonly used for ventilation, in manufacturing, for winnowing grain, to remove dust, cuttings, or other waste, or to provide draft for a fire. They are also used to move air for cooling purposes, as in automotive engines and air-conditioning systems. Fans may be driven by belts or by direct motor. The axial-flow fan (e.g., an electric table fan) has blades that force air to move parallel to the shaft about which the blades rotate.

Tape drives used in computer equipment include tape drive motors for transferring a length of tape media between a supply reel and a takeup reel as a read/write head reads/writes data from/to the length of tape medium. As the tape medium is transferred from the supply reel to the takeup reel, the supply and takeup reels rotate in one direction. Transferring the length of tape media from the takeup reel back to the supply reel requires rotation of the supply and takeup reels in the reverse direction. Similarly, an axial-flow fan rotates fan blades clock-wise for air movement in one direction and changes the direction for air low in the opposite direction. An axial-flow fan connected to the tape drive motor would direct air low in an opposite direction related to the rotational direction of the tape drive motor. In one rotational direction the fan blades may move heated operating air away from the heat producing electronic components. When the tape drive is rotating in the reverse direction, the fan blades push the heated operating air in the direction of the heat producing electronic components. The present forced air fan having pivotal fan blades for unidirectional air flow creates an axial flow of air in one direction, regardless of the directional rotation of the motor. Thus, allowing a standard bi-directional disk drive motor to provide forced air cooling during normal operation.

Figure 1:
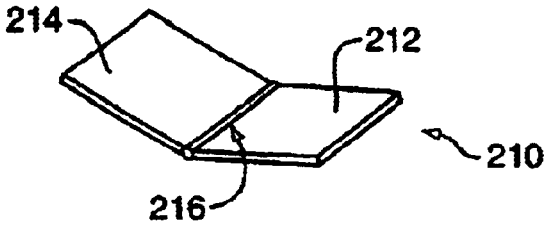
FIG. 1 illustrated a perspective view of a V-shaped fan blade of the present forced air cooling fan having pivotal fan blades unidirectional air flow.

The fan blades used in the present forced air fan having pivotal fan blades for unidirectional air flow achieve the desired result by use of passive pivoting blades which are rotated into the correct position by the force of the airflow itself. This allows for a simple design that has only one moving part per blade and does not require high speeds to work effectively. Referring to FIG. 1, the fan blade 210 includes a pivoting device 216 having a first blade member 212 on one side and a second blade member 214 on the opposing side, forming a V-shaped fan blade 210.

Figure 2:
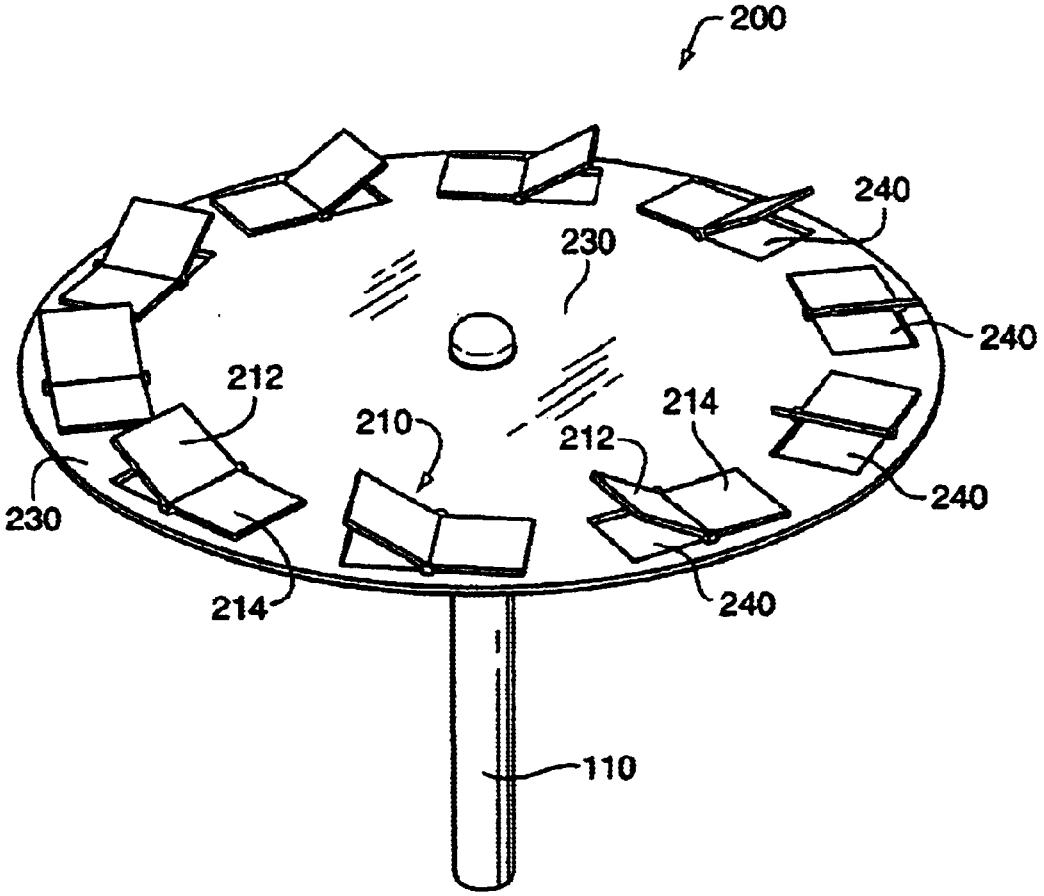
FIG. 2 illustrates a perspective view of a plurality of V-shaped fan blades connected to a disk to form the present forced air cooling fan having pivotal fan blades for unidirectional air flow.

Referring to FIG. 2, a plurality of fan blades 210 may be connected around the periphery of a disk-shaped member, forming a fan 200. The fan 200 may comprise a flat disk 230 having a series of circumferentially spaced apertures 240 around the periphery of the disk 230. A V-shaped fan blade 210 is pivotally connected across each aperture 240 perpendicular to the periphery of the disk. The axis about which the V-shaped fan blade pivots are arranged radially from the center of the disk 230 such that the centrifugal forces have no effect on tendency of the V-shaped fan blade to pivot about its own axis. The V-shaped fan blade 210 divides the aperture 240 into a first aperture 232 and a second aperture 234. A first or second fan blade 212 or 214 relative to the rotational direction of the tape drive motor covers one of the first and second apertures 232 and 234. When the rotational direction is reversed, the opposite one of the first and second fan blades covers the opposite one of the first and second apertures 232 and 234.

Figure 3:
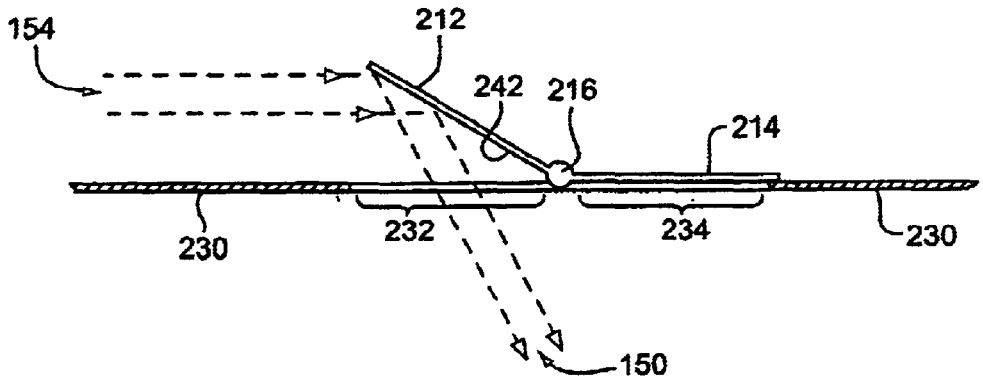
FIG. 3 illustrate a side view of the V-shaped fan blade in a first pivotal positions in accordance with the present forced air cooling fan having pivotal fan blades unidirectional air flow.
Figure 4:
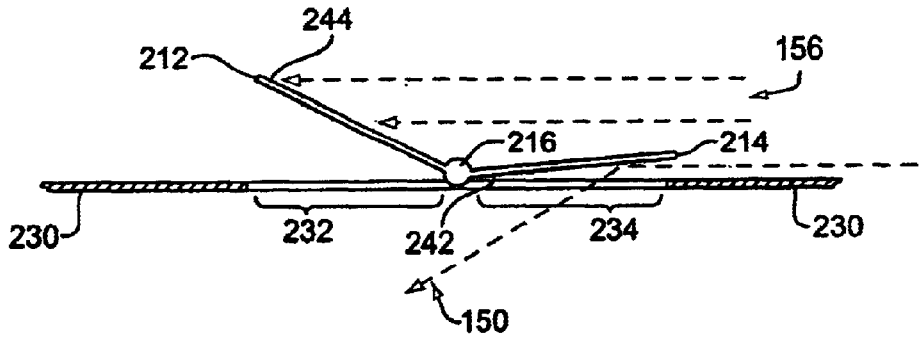
FIG. 4 illustrate a side view of the V-shaped fan blade in a second pivotal position in accordance with the present forced air cooling fan having pivotal fan blades unidirectional air flow.
Figure 5:
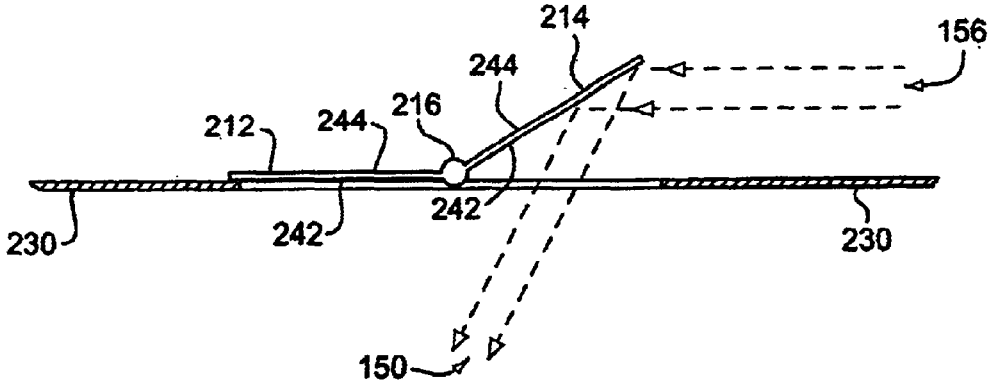
FIG. 5 illustrate a side view of the V-shaped fan blade in a third pivotal position in accordance with the present forced air cooling fan having pivotal fan blades unidirectional air flow.

Referring to the side view illustration of the fan blade movement of FIGS. 3, 4 and 5, when the shaft 110 of the disk drive is rotating, the air flow causes the series of V-shaped fan blades 210 to pivot in a uniform direction. Referring to FIG. 3, as the air flow 154 contacts the interior surface 242 of the upwardly extended first blade member 212, contact with the first blade member 212 interior surface 242 applies a force to maintain the pivotal position of the fan blade 210. When the first blade member 212 is fully extended upward, the first aperture 232 is uncovered and second blade member 214 covers the second aperture 234. The upwardly extending first blade member 212 directs the flow of air downwardly through the first aperture 232 to produce a downwardly directed axial flow of air 150.

Referring to FIG. 4, when the directional rotation of the tape drive motor, and therefore the fan, is reversed, the air flow generated by the rotation is in an opposing rotational direction. The flow of air 156 contacts the exterior surface 244 of the first blade member 212 and applies a force pivoting the upwardly extended first blade member 212 downward. Since the V-shaped fan blade is balanced, it takes only a slight flow of air to cause the V-shaped fan blade to change positions.

Downwardly movement of the first blade member 212 causes an equal and opposite upwardly movement of the opposing second blade member 214 as illustrated in FIG. 4. Upward movement of the opposing second blade member 214 partially uncovers the second aperture 234 allowing a portion of the air flow to contact the interior surface 242 of the opposing second blade member 214. The air flow into the second aperture 234 applies an additional force to the interior surface 242 of the second blade member 214 to rotate the opposing second blade member 214 in the upwardly direction illustrated in FIG. 5. When the second blade member 214 is fully extended upward, the second aperture 234 is uncovered and first blade member 212 covers the first aperture 232. The upwardly extending second blade member 214 directs the flow of air downwardly through the second aperture 234 to produce a downwardly directed axial flow of air 150 as illustrated in FIG. 5.

The angle between the first and the second blade members provides the slope that directs the flow of air downward. As the angle is increased, the interior surface of the blade member contacts a decreasing amount of air resulting in a decreased flow of cooling air. The angle between the first and the second fan blade also changes the angle at which the air is deflected off of the interior surface. The angle between the first and the second blade member also changes the drag the fan places on the disk drive motor. For optimal operation, the angle should be greater that ninety degrees and less than one hundred and eighty degrees. The V-shaped fan blade illustrated in FIGS. 3–5 has approximately a one hundred and thirty-five-degree angle.

The present forced air cooling fan having pivotal fan blades for unidirectional air flow allows a bi-direction rotating device such as a tape drive reel motor to be utilized for producing a unidirectional flow of forced air. Pivoting V-shaped fan blades allow the fan blades to rotate between positions relative to the directional rotation of the fan. Providing a forced air cooling fan that is driven by an existing tape drive motor decreases the area required for a forced air cooling fan by utilizing the existing tape drive motor to rotate the fan blades. Pivoting the fan blades between a first position and a second position allows the directional rotation of the fan to reverse without changing the direction of the forced axial flow of air.

While the present forced air cooling fan having pivotal fan blades for unidirectional air flow has been described for use in conjunction with a tape drive motor, alternative uses may be substituted. Likewise, while the first and second apertures are illustrated and described as being formed from a single aperture divided by the pivoting V-shaped fan blade, the first and second apertures may be separate apertures wherein the pivoting V-shaped fan blade is connected between the first and second apertures.

It is apparent that there has been described, forced air cooling fan having pivotal fan blades for unidirectional air flow that fully satisfies the objects, aims, and advantages set forth above. While the forced air cooling fan having pivotal fan blades for unidirectional air flow has been described in conjunction with specific embodiments thereof, it is evident that many alternatives, modifications, and/or variations can be devised by those skilled in the art in light of the foregoing description. Accordingly, this description is intended to embrace all such alternatives, modifications and variations as fall within the spirit and scope of the appended claims.

What is claimed is:

1. An apparatus for generating a forced flow of air in a predetermined axial direction, the apparatus comprising:

a disk-shaped member having a series of spaced apertures located around he periphery of the disk-shaped member;

a drive means centrally connected to the disk-shaped member for rotating the disk-shaped member about a rotational axis; and a plurality of V-shaped fan blades each pivotally connected across one of the series of spaced apertures and pivoting about an axis radial to the disk-shaped member, wherein the plurality of V-shaped fan blades direct a flow of air through the plurality of spaced apertures to generate the axial flow of air in the predetermined axial direction.

2. The apparatus for generating a forced flow of air in a predetermined axial direction of claim 1 wherein the V-shaped fan blade comprises:

a pivoting means having a first side and a second side;

a first blade member connected to the first side of the pivoting means; and a second blade member angularly connected to the second side of the pivoting means to form the V-shaped fan blade.

3. The apparatus for generating a forced flow of air in a predetermined axial direction of claim 1 wherein the drive means is a disk drive motor having a shaft wherein the shaft is perpendicularly connected to the center of the disk-shaped member.

4. A forced air cooling fan comprising:

a disk-shaped member having a plurality of spaced apertures around a periphery of the disk-shaped member;

a bi-directional rotating means centrally connected to the disk-shaped member for rotating the disk-shaped member about a rotational axis;

a plurality of V-shaped fan blades each pivotally connected across one of the plurality of spaced apertures and perpendicular to the periphery of the disk-shaped member and operative to generate an axial flow of air in response to rotation of the disk-shaped member about a rotational axis; and wherein the position of the plurality of V-shaped fan blades is relative to the rotational direction of the rotational means and the direction of the axial flow of air in response to the rotation of the disk-shaped member is independent of the rotational direction of the rotating means.

5. The forced air cooling fan of claim 4 wherein the V-shaped fan blade comprises:

a first blade member;

a second blade member angularly connected to the first blade member to form the V-shaped fan blade; and a pivoting means connected between the first and the second blade members for pivoting the V-shaped fan blade in a direction radial to the rotation of the disk-shaped member.

6. The forced air cooling fan of claim 4 wherein the bi-directional rotating means is a disk drive motor having a shaft wherein the shaft is perpendicularly connected to the center of the disk-shaped member.

7. An apparatus for generating a forced air flow in a predetermined direction, the apparatus comprising:

a disk-shaped member;

a series of spaced apertures in groups of two apertures located around a periphery of the disk-shaped member;

a rotational drive means for rotating the disk-shaped member about a rotational axis; and a plurality of V-shaped fan blades having a first blade member and a second blade member and a pivoting means therebetween, wherein each one of the plurality of V-shaped fan blades is pivotally connected between one of the groups of two apertures radial to the rotational axis and the V-shaped fan blade pivots to alternately cover one of the group of two apertures relative to the rotational direction of the disk-shaped member to generate the forced air flow in the predetermined direction.

8. The apparatus for generating a forced flow of air of claim 7 wherein the rotational drive means is a disk drive motor having a shaft wherein the shaft is perpendicularly connected to the center of the disk-shaped member.

9. An apparatus for generating a forced axial air flow in a predetermined direction, the apparatus comprising:

a disk-shaped member having a plurality of spaced apertures located around the periphery of the disk-shaped member;

a rotational drive means for rotating the disk-shaped member about a rotational axis; and a plurality of V-shaped fan blades each pivotally connected across one of the plurality of apertures and perpendicular to the periphery of the disk-shaped member and operative to generate the forced flow of air in response to rotation of the disk-shaped member about the rotational axis, the V-shaped fan blades comprising:

a pivoting means having a first side and a second side;

a first blade member connected to the first side of the pivoting means;

a second blade member angularly connected to the second side of the pivoting means to form the V-shaped fan blade; and wherein the V-shaped fan blade pivots and the first and second blade members alternately cover a corresponding portion of one of the apertures relative to the rotational direction of the disk-shaped member to generate the forced axial flow of air in the predetermined direction.

10. A method of generating an axial flow of air in a predetermined direction utilizing an axial fan having disk-shaped member containing a series of V-shaped fan blades disposed across a series of spaced apertures located around the periphery of the disk-shaped member, the method comprising:

engaging the disk-shaped member with a rotating drive;

the rotating drive, rotating the disk-shaped member in a first direction about a rotational axis to interact with the surrounding air to pivot the V-shaped fan blades to a first uniform position; and generating the axial flow of air in the predetermined axial direction in response to rotation of the disk-shaped member.

11. The method of claim 10 further comprising:

rotating the disk-shaped member in a reverse direction about a reverse rotational axis to interact with the surrounding air to pivot the V-shaped fan blades to a second uniform position; and generating the axial flow of air in the predetermined axial direction in response to rotation of the disk-shaped member.

* * * * *